US007850018B2

(12) United States Patent
Galle

(10) Patent No.: US 7,850,018 B2
(45) Date of Patent: Dec. 14, 2010

(54) ADJUSTABLE MULTI-HOOK BAG DISPENSING RACK SYSTEM, AND BAGS THEREFORE

(75) Inventor: Francis B. Galle, Missouri City, TX (US)

(73) Assignee: Advance Polybag, Inc., Sugar Land, TX (US)

( * ) Notice: Subject to any disclaimer, the term of this patent is extended or adjusted under 35 U.S.C. 154(b) by 351 days.

(21) Appl. No.: 11/962,347

(22) Filed: Dec. 21, 2007

(65) Prior Publication Data

US 2008/0149785 A1 Jun. 26, 2008

Related U.S. Application Data

(60) Provisional application No. 60/871,166, filed on Dec. 21, 2006.

(51) Int. Cl.
*A47G 29/00* (2006.01)

(52) U.S. Cl. ..... 211/85.15

(58) Field of Classification Search ..... 211/12, 211/85.15, 106.01, 106, 57.1, 59.1; 248/95, 248/99, 100, 101; 383/6, 12, 22, 23; 221/92, 221/134, 303, 304

See application file for complete search history.

(56) References Cited

U.S. PATENT DOCUMENTS 3,854,588 A * 12/1974 Kinard ..... 211/85.7
4,155,461 A * 5/1979 Young, Jr. ..... 211/106.01
5,031,783 A * 7/1991 Goudreau ..... 211/181.1
5,303,830 A * 4/1994 Metcalf ..... 211/57.1
5,503,277 A * 4/1996 O'Brien ..... 211/106.01
5,732,833 A * 3/1998 Alvarado et al. ..... 211/59.1
5,887,731 A * 3/1999 Thalenfeld ..... 211/57.1
6,059,124 A * 5/2000 Weck et al. ..... 211/57.1
6,299,001 B1 * 10/2001 Frolov et al. ..... 211/106
6,308,842 B1 * 10/2001 Robbins et al. ..... 211/113
6,520,351 B1 * 2/2003 Zadro ..... 211/119
6,758,355 B2 * 7/2004 Zidek ..... 211/205
7,178,681 B2 * 2/2007 Libman ..... 211/106
7,243,884 B2 * 7/2007 Lawson et al. ..... 248/95
7,484,701 B2 * 2/2009 Hsieh ..... 248/339
2003/0168419 A1 * 9/2003 Rodrigue ..... 211/59.1
2005/0263466 A1 * 12/2005 Libman ..... 211/106
2006/0091092 A1 * 5/2006 Vosbikian ..... 211/87.01
2007/0251904 A1 * 11/2007 Winig et al. ..... 211/106.01

* cited by examiner

*Primary Examiner*—Jennifer E. Novosad
(74) *Attorney, Agent, or Firm*—Joseph T Regard Ltd plc

(57) ABSTRACT

A bag rack which is configured to support and dispense bags from bag stacks of varying size, wherein a larger size bag pack is positioned to receive a smaller bag pack overlying fashion, the bags positioned so that the smaller bag pack is situated distal the rack and closer to the user, the larger bag pack situated closer to the bag rack, with the smaller pack situated thereupon relative to the user. The rack of the present system comprises contemplates a generally horizontally situated support bar having provided thereon, in slidingly adjustable fashion, support hooks or prongs formed to engage support apertures in the handles of the bags. The exemplary embodiment of the present invention contemplates multiple aligned, horizontally situated support bars which allows the user to selectively mount the support hooks for different sized bag packs at different spacing and heights relative to one another, to optimize the positioning of the various bag packs for optimal dispensing efficiency, while providing diversity as to the size of bag packs which can be dispensed.

2 Claims, 15 Drawing Sheets

ISOMETRIC VIEW

EXPLODED VIEW

TOP VIEW

SIDE VIEW

ISOMETRIC VIEW

27'
27
25
26
11GA CRS X2
SIDE VIEW

ITEM | A | B
OUTER HOOK | 11/16" | 2 11/16"
INNER HOOK | 1 3/16" | 2 3/16"
3/8"
9
ø1/4"SOLID BAR
TOP VIEW

ø7/32"ID(HOLD) X2
24
23
3/4"CC (HOLD)
9/32"OC
1 1/4"OD
DRILL #6-32 HOLE THRU (1)WALL
24'
20'
A OD
3/32" (REF)
90°
21
B OD
90°
1/2" OC
22'
22
11/16"OD
20
FRONT VIEW

ADJUSTABLE MULTI-HOOK BAG DISPENSING RACK SYSTEM, AND BAGS THEREFORE

BENEFIT CLAIM

This application claims the benefit of Provisional Patent Application Ser. No. 60/871,166 filed Dec. 21, 2006 listing Frances B. Galle as inventor.

TECHNICAL FIELD OF THE INVENTION

The present invention relates to grocery bag racks and the like, and in particular to a bag rack which is configured to dispense bags from bag stacks of varying size.

GENERAL SUMMARY DISCUSSION OF THE INVENTION

The present invention relates to grocery bag racks and the like, and in particular to a bag rack which is configured to support and dispense bags from bag stacks of varying size, wherein a larger size bag pack is positioned to receive a smaller bag pack overlying fashion, the bags positioned so that the smaller bag pack is situated distal the rack and closer to the user, the larger bag pack situated closer to the bag rack, with the smaller pack situated thereupon relative to the user.

The rack of the present system comprises contemplates a generally horizontally situated support bar having provided thereon, in slidingly adjustable fashion, support hooks or prongs formed to engage support apertures in the handles of the bags. The exemplary embodiment of the present invention contemplates multiple aligned, horizontally situated support bars which allows the user to selectively mount the support hooks for different sized bag packs at different spacing and heights relative to one another, to optimize the positioning of the various bag packs for optimal dispensing efficiency, while providing diversity as to the size of bag packs which can be dispensed.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 4C is a close-up view of the support aperture of FIG. 4B, with an exemplary support hook situated there through.

DETAILED DISCUSSION OF THE INVENTION

Figure 1B:
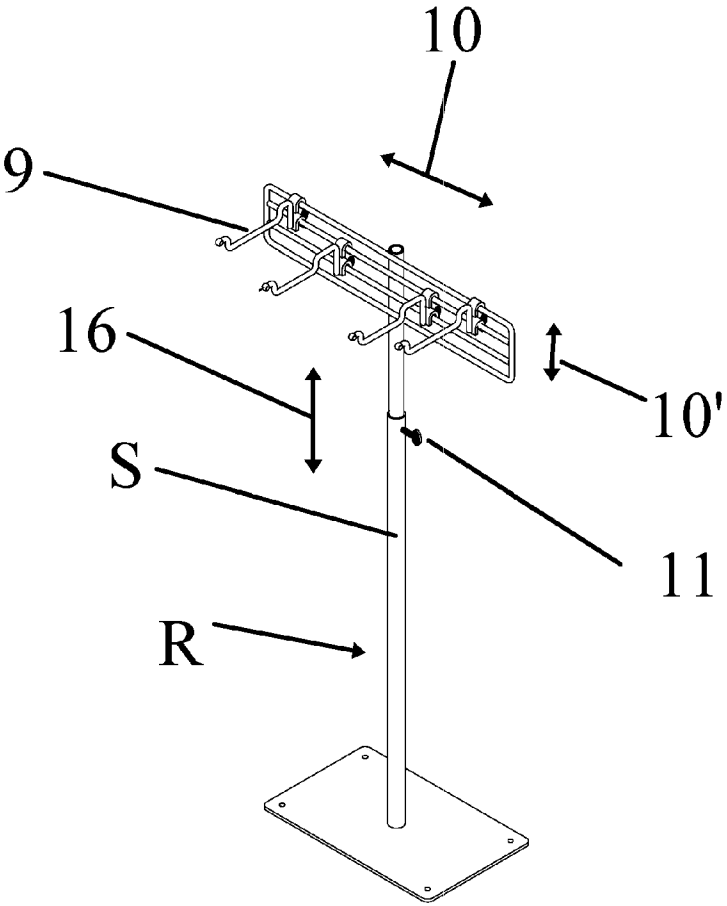
FIG. 1B is an isometric view isometric view of the preferred embodiment of the present invention.
Figure 1A:
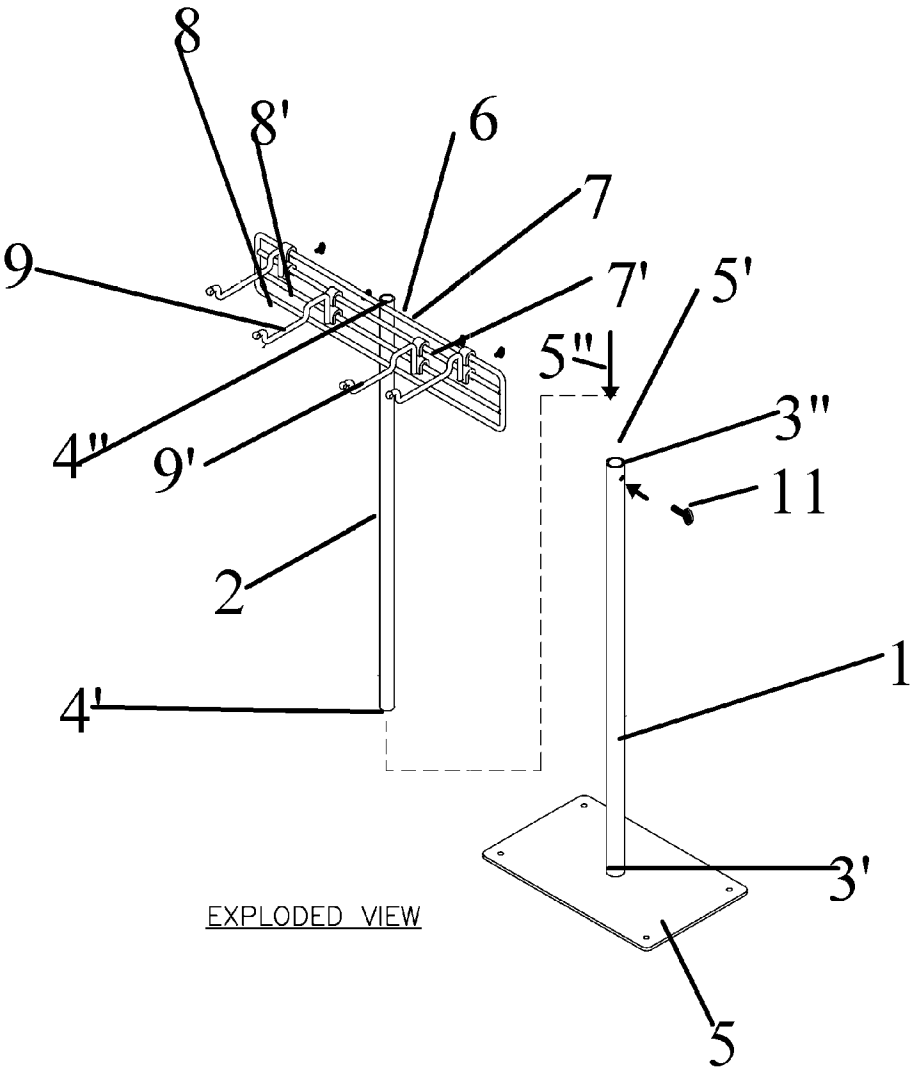
FIG. 1A is an exploded, isometric view of the preferred embodiment of the present invention of FIG. 1B.
Figure 1D:
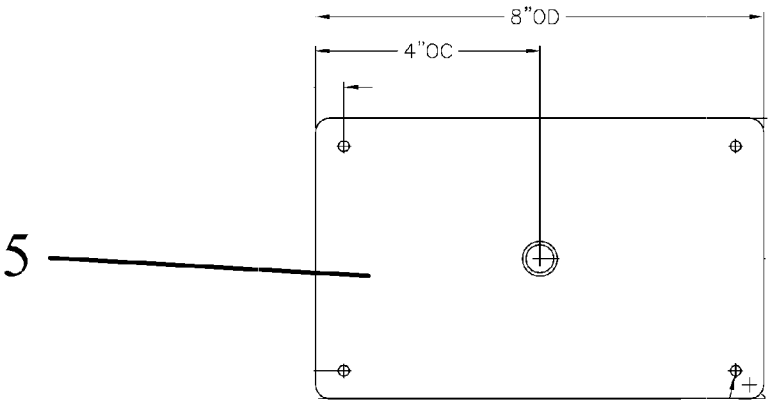
FIG. 1D is a bottom view of the preferred embodiment of the present invention of FIG. 1B.
Figure 1C:
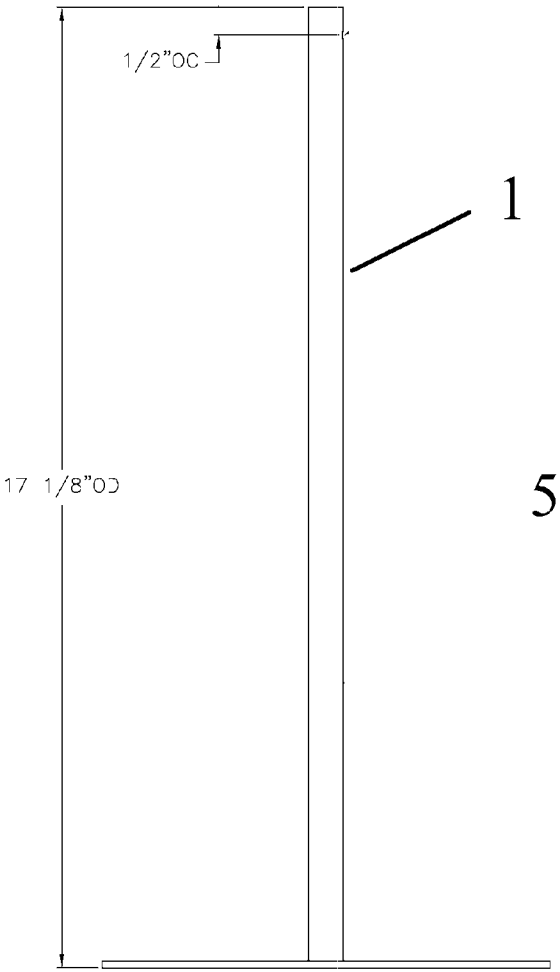
FIG. 1C is a partial, side view of the lower portion of the preferred embodiment of the present invention of FIG. 1B.
Figure 1F:
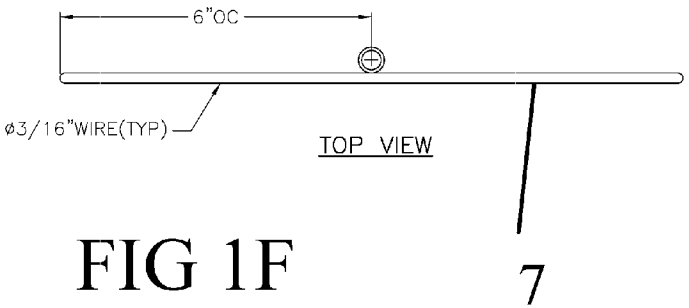
FIG. 1F is a top view of the preferred embodiment of the present invention of FIG. 1B.
Figure 1E:
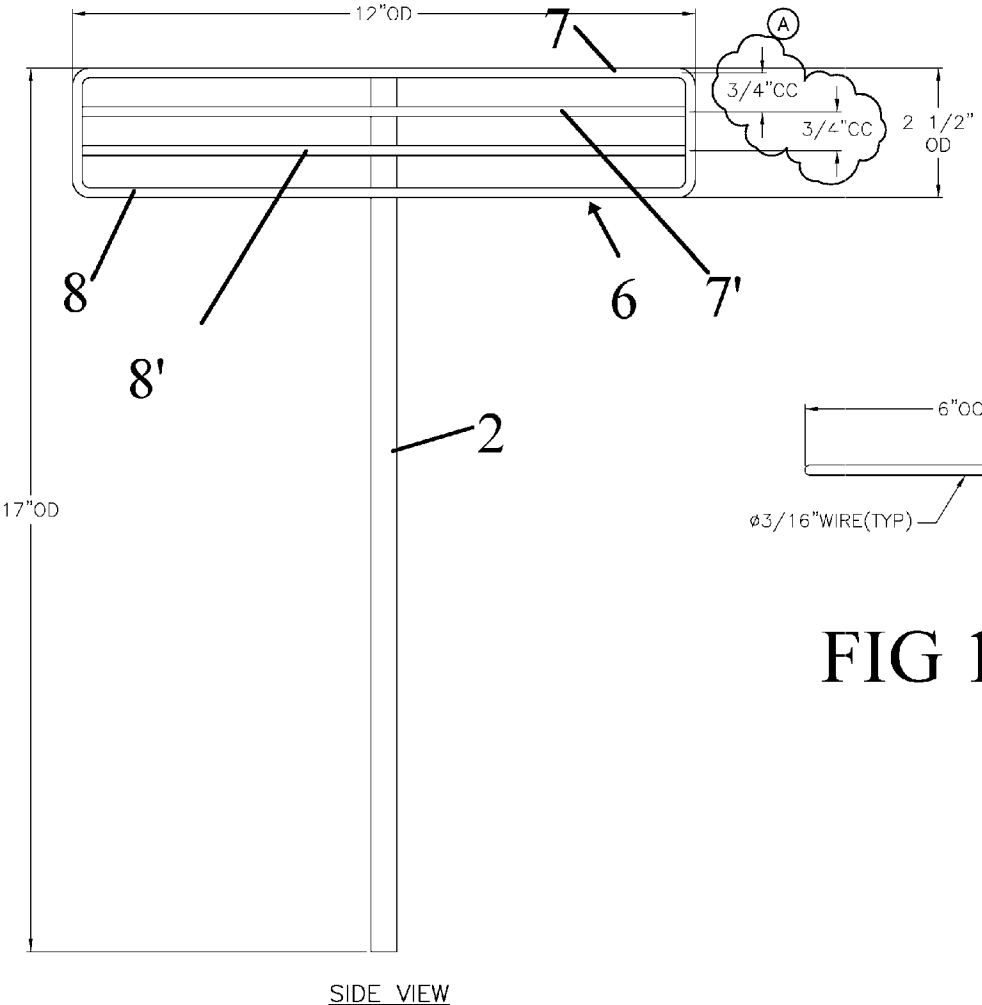
FIG. 1E is a partial, side view of the upper portion of the preferred embodiment of the present invention of FIG. 1B.
Figures 2A, 2B, 2C, 2D:
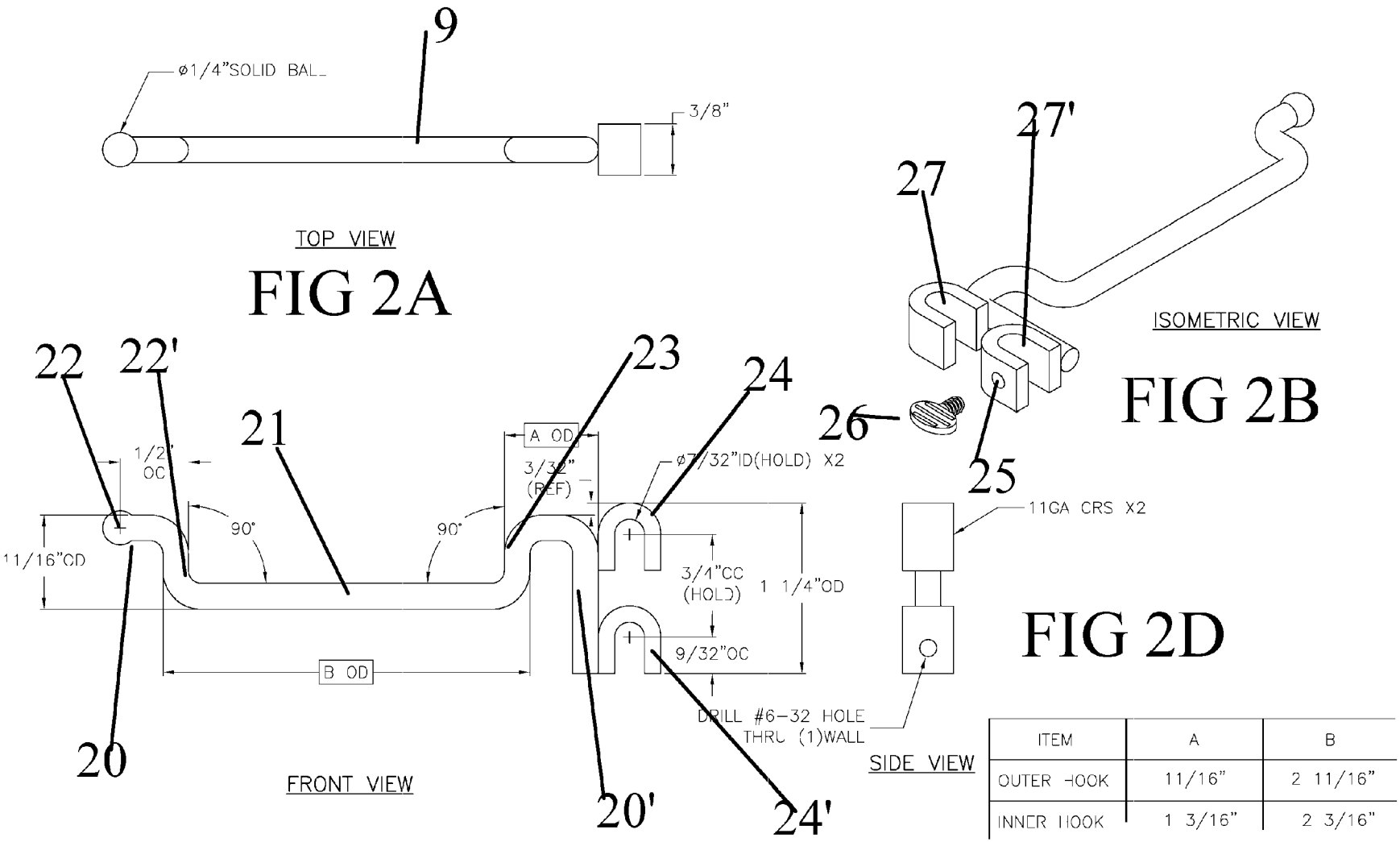
FIG. 2A is a top view of the support hook of the preferred embodiment of the present invention of FIG. 1B.
FIG. 2B is an isometric view of the support hook of the preferred embodiment of the present invention of FIG. 1B.
FIG. 2C is a side view of the support hook of the preferred embodiment of the present invention of FIG. 1B.
FIG. 2D is an end view of the support hook of the preferred embodiment of the present invention of FIG. 1.

Referring to FIGS. 1A-1F, the preferred embodiment of the present invention utilizes a rack R having a vertical support S formed of lower 1 and upper 2, support components, the lower 1 component having first 3' and second 3" ends, the upper 2 support component having first 4' and second 4" ends, the second end 3" of the lower support component having an inner diameter formed to receive 5' the outer diameter of the first end 4' of the second upper 2 support component, so as to provide variable height adjustment 16 which may be fixed via threaded engagement member 11 (thumb screw) engaging a threaded aperture, as shown.

The first end 3' of the lower 1 support component as affixed thereto a base 5 to support the vertical support S in a vertical position. At the second 4" end of the upper 2 support component is mounted, in transverse fashion, a generally horizontally situated support component 6 having a front face and a rear face, the rear face mounted to the second end of the upper support component, the front face configured to have multiple support hooks emanating therefrom, as will be more fully explained infra.

As shown, the support component 6 is comprised of at least one horizontal support bar 7, with the preferred embodiment of the invention utilizing a support component 6 further having second 7', third 8, and fourth 8' support bars situated in evenly spaced, longitudinally aligned fashion, and along a common vertical plane, so as to provide support surfaces for mounting support hooks 9, 9', which may be selectively mounted along the length 10 and height 10' of said support component 6.

Continuing with FIGS. 2A-2D, 1B and 3D, these support hooks 9 of the present invention are shown having a length having first 20 and second 20' ends, and a medial support length 21 their between. The second 20' end is formed to mount the support component 6, having first 24 and second 24' bar mounting brackets 24, 24' having slots 27, 27' forms they are in, respectively, to slip over 30 slidingly 31 engage adjacent support bars (for example, bars 7', 8') of said support component 6, which mounting brackets 24, 24' may be locked to said support bars 7', 8' by threadingly engaging thumb screw 26, which passes through threaded aperture 25 formed in bracket 24'. Once engaged to the support bar, the support hook 9 is formed to provide a generally horizontal support area 21 (although said support hook could be formed in various configurations), the support bar having a raised 22' area at the distal first end 20, terminating in a stop 22, shown as a bulbous tip.

Figure 3A:
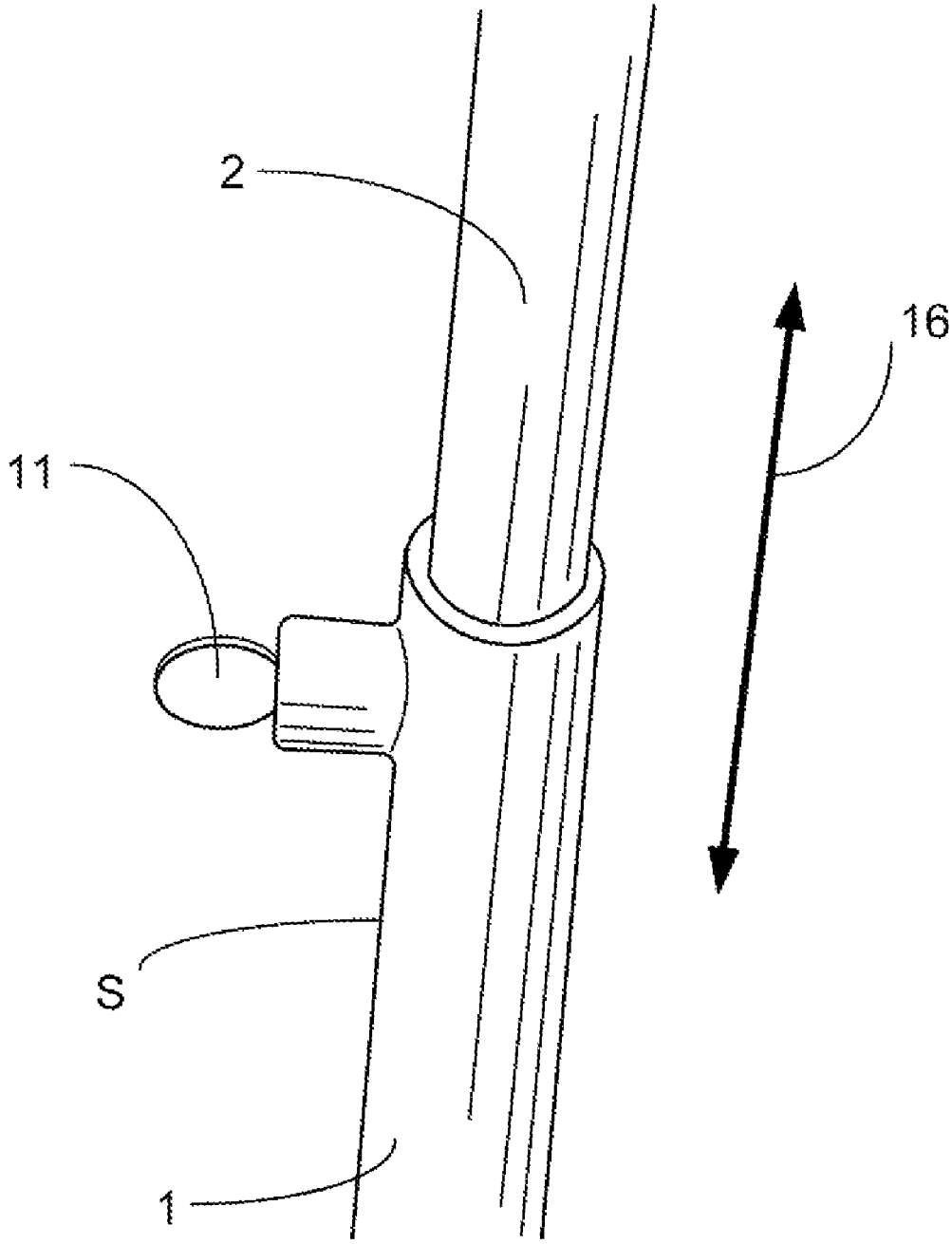
FIG. 3A is an isometric, partial, close up view of the vertical adjustment mechanism associated with the medial area of the stand of FIG. 1B.
Figure 3B:
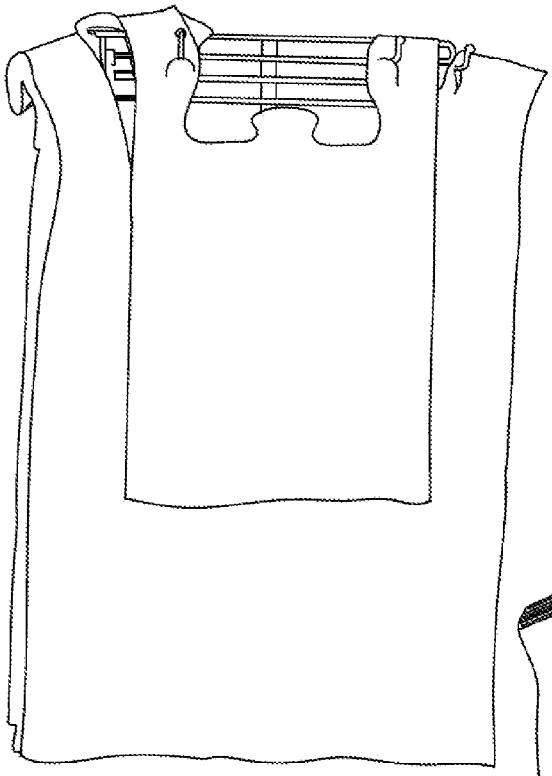
FIG. 3B is a frontal view of the preferred embodiment of the present invention, illustrating first and second stacks of bags mounted on the rack and supported by first and second sets of support hooks, with the second, smaller bag stack overlying the first, larger bag stack.
Figure 3F:
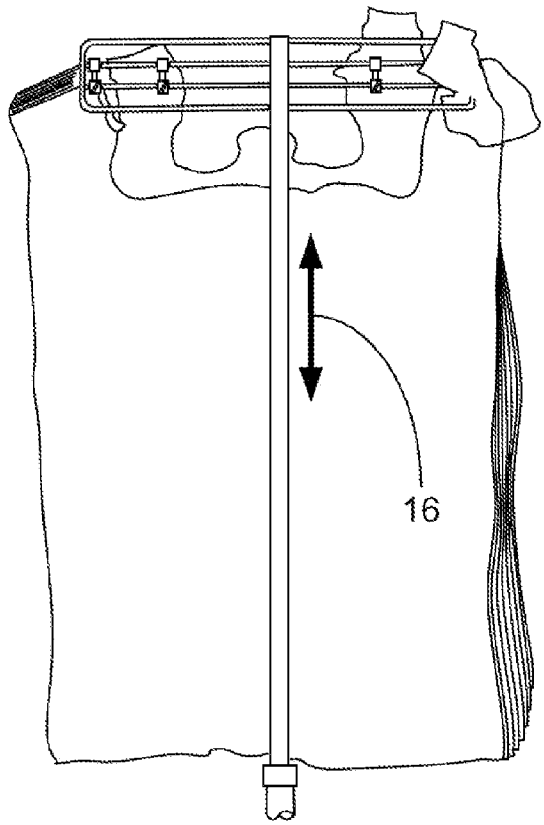
FIG. 3F is a rear view of the preferred embodiment of the present invention, illustrating first and second stacks of bags mounted on the rack and supported by first and second sets of support hooks, with the second, smaller bag stack overlying the first, larger bag stack.
Figure 3C:
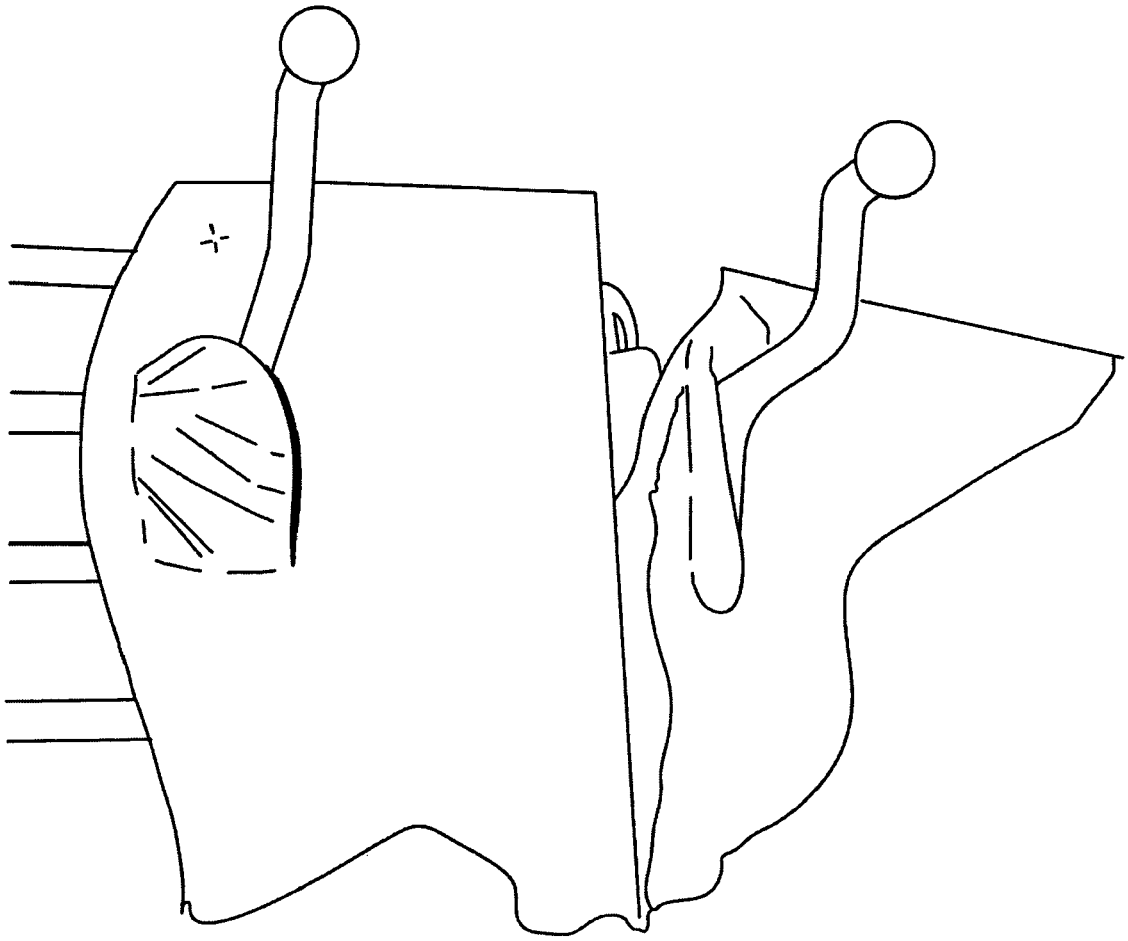
FIG. 3C is a frontal, partial, close-up view of the support hooks passing through the handle support apertures on one end of the rack of FIG. 3B.
Figure 3D:
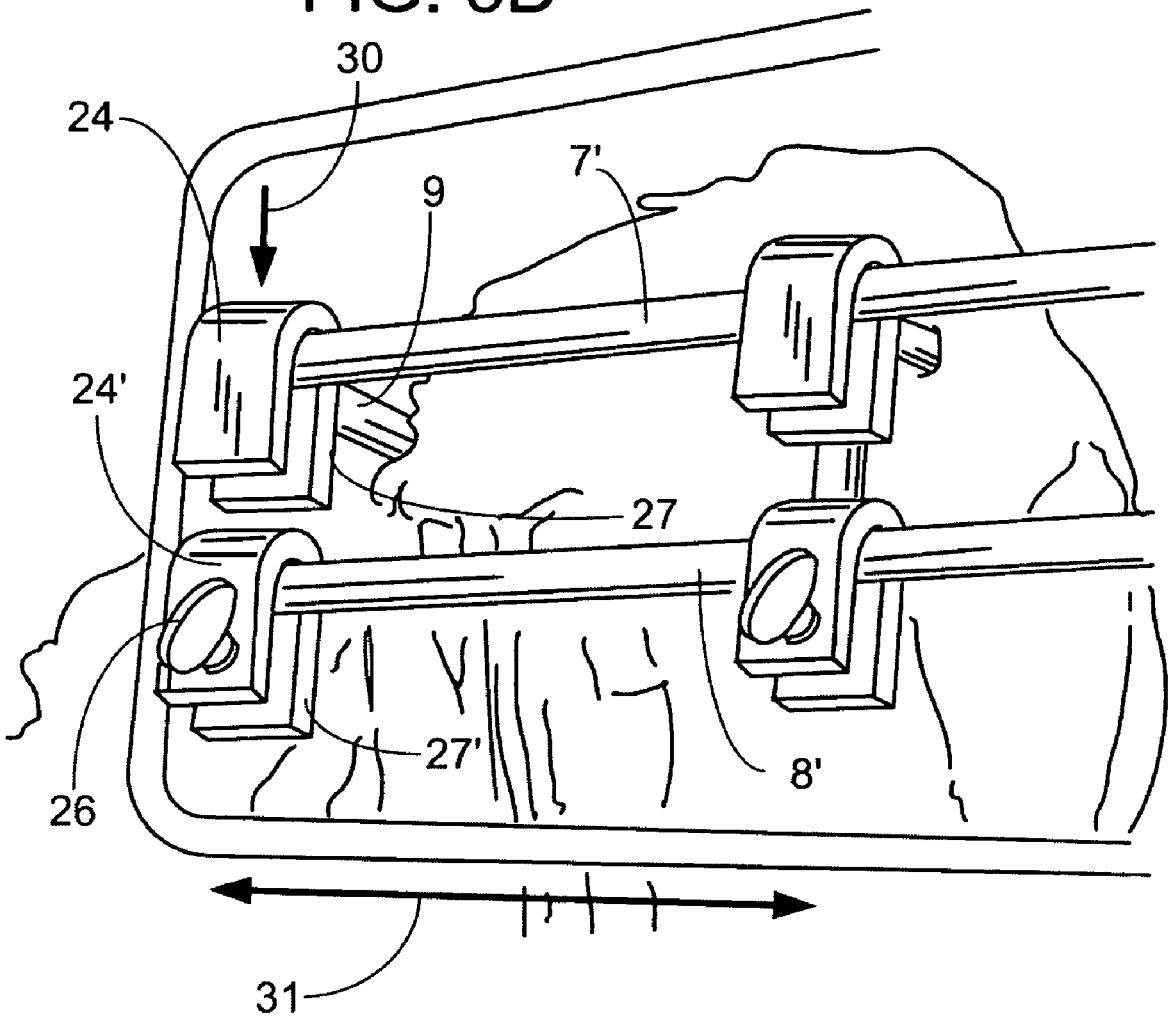
FIG. 3D is a frontal, slightly isometric, partial, close up view of the end of the rack associated with FIG. 3C, illustrating multiple, aligned, generally horizontal support bars, and the mounting of the support hooks thereon.
Figure 3E:
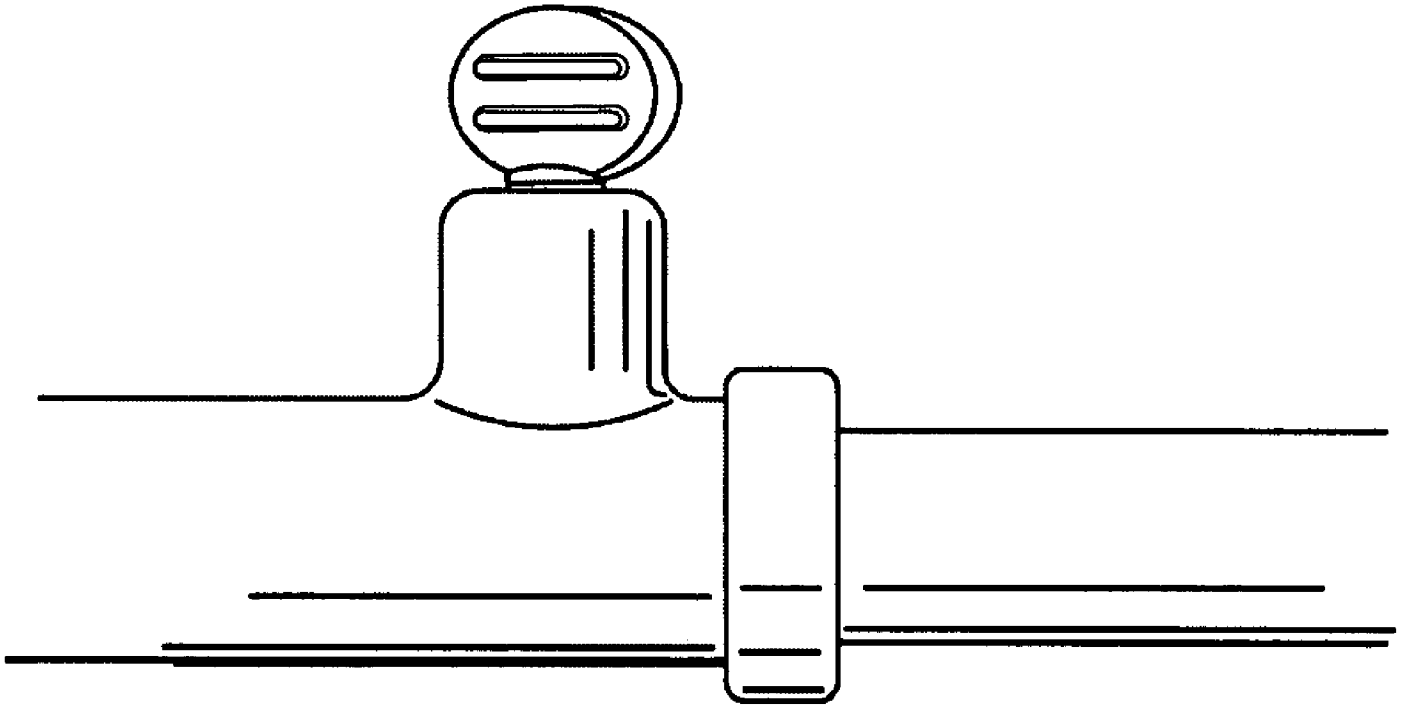
FIG. 3E is a rear, partial, close up view of the vertical adjustment mechanism associated with the medial area of the stand of FIG. 1B, also shown in FIG. 3A.
Figure 3G:
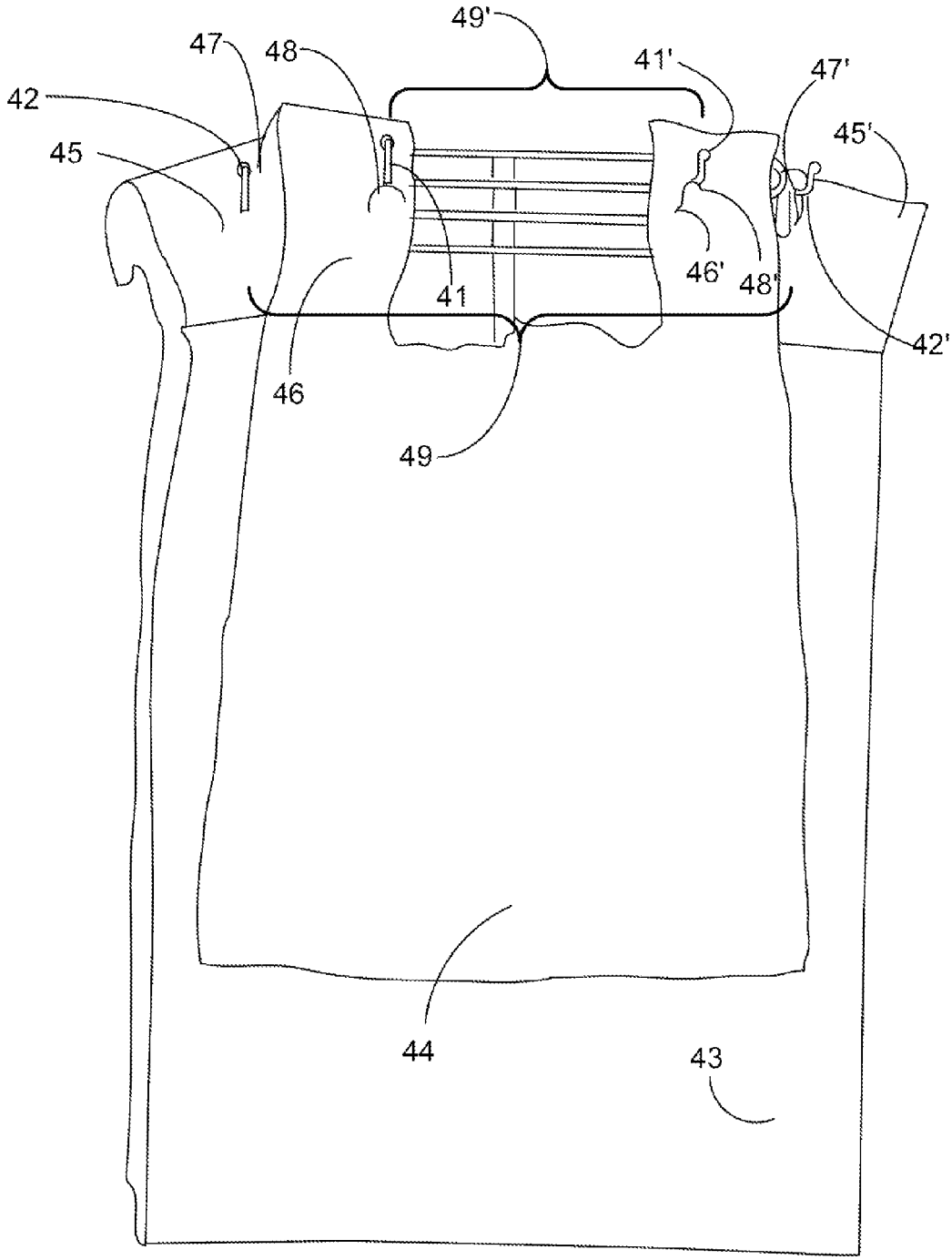
FIG. 3G is a frontal view of the preferred embodiment of the present invention, illustrating first and second stacks of bags mounted on the rack and supported by first and second sets of support hooks, with the second, smaller bag stack overlying the first, larger bags stack.

Continuing with FIGS. 3F and 3G, the user configures the rack by vertically adjusting 16 it to the appropriate height via the telescoping vertical support adjustment earlier disclosed, then positions the support hooks on the rack so as to support the stacks of bags desired for dispensing. As shown, the rack system of FIG. 3G is configured to dispense T-shirt bags, particularly a larger stack of T-shirt bags 43 having first 45 and second 45' handles having support apertures 47, 47', respectively, as well as a smaller stack of T-shirt bags 44 having first 46 and second 46' handles having support apertures 48, 48', respectively.

In use, the user mounts the support hooks to the rack, with the outermost support hooks 42, 42' spaced apart equidistant from the vertical support number, these support hooks 42, 42' spaced a distance 49 correlating to the distance between the handle support apertures 47, 47' of the larger stack of T-shirt bags 43.

After the user mounts between the outermost support hooks 42, 42', the support hooks 41, 41' for the smaller stack of bags 44 are mounted, said support hooks 41, 41' likewise are spaced apart equidistant in relation to the vertical support member, at a distance 49' correlating to the distance between the handle support apertures 48, 48' of the smaller bag stack 44.

Once the hooks have been mounted accordingly, the user then mounts the larger stack of bags 43 first on the rack by passing support hook 42 through support aperture 47 on handle 45, as well as passing support hook 42' through support aperture 47' on handle 45'.

The user then mounts the smaller stack of bags 44 to the rack by passing the support hook 41 through handle support aperture 48, then support hook 41' through handle support aperture 48', so as to over lie the smaller backpack 44 over the larger backpack 43, thereby allowing the user open, easy access to the smaller pack of bags, as well as the larger stack of bags there behind.

FIGS. 4A-4D illustrate a close-up view of the support aperture 47' in handle 45' in the larger T-shirt bag stack 43 shown in the figures, although this support aperture configuration may be used with any of the T-shirt bags dispensed in the present system.

As shown, the support aperture 47' is formed via a die cut, and has a configuration similar to a backwards "C", having first 51 and second 52 ends curving 55', 55, respectively, into a intermediate portion 53. As shown, the upper, first end terminates in a line approximately transverse the inner edge 54 of the bag handle 45' end, and is spaced 56 from said inner edge 54 a nominal distance (for example, 3⁄32 of an inch but can vary depending upon the plastic used, thickness, etc), adequate to support lead bag stack on the rack, while facilitating tearing or rupturing of the film spaced 56 there between upon dispensing, providing a rupture area R. The bags of the present invention may comprise, for example, a co-extruded HDPE based T-Shirt bag by Advance Polybag, Inc., of Houston, Tex.

The second end 52 of the support aperture die cut terminates in a line generally parallel to the inner edge 54 of the bag handle, and is spaced 56' a distance from said edge to discourage rupture or tearing of the film there between.

Figure 3H:
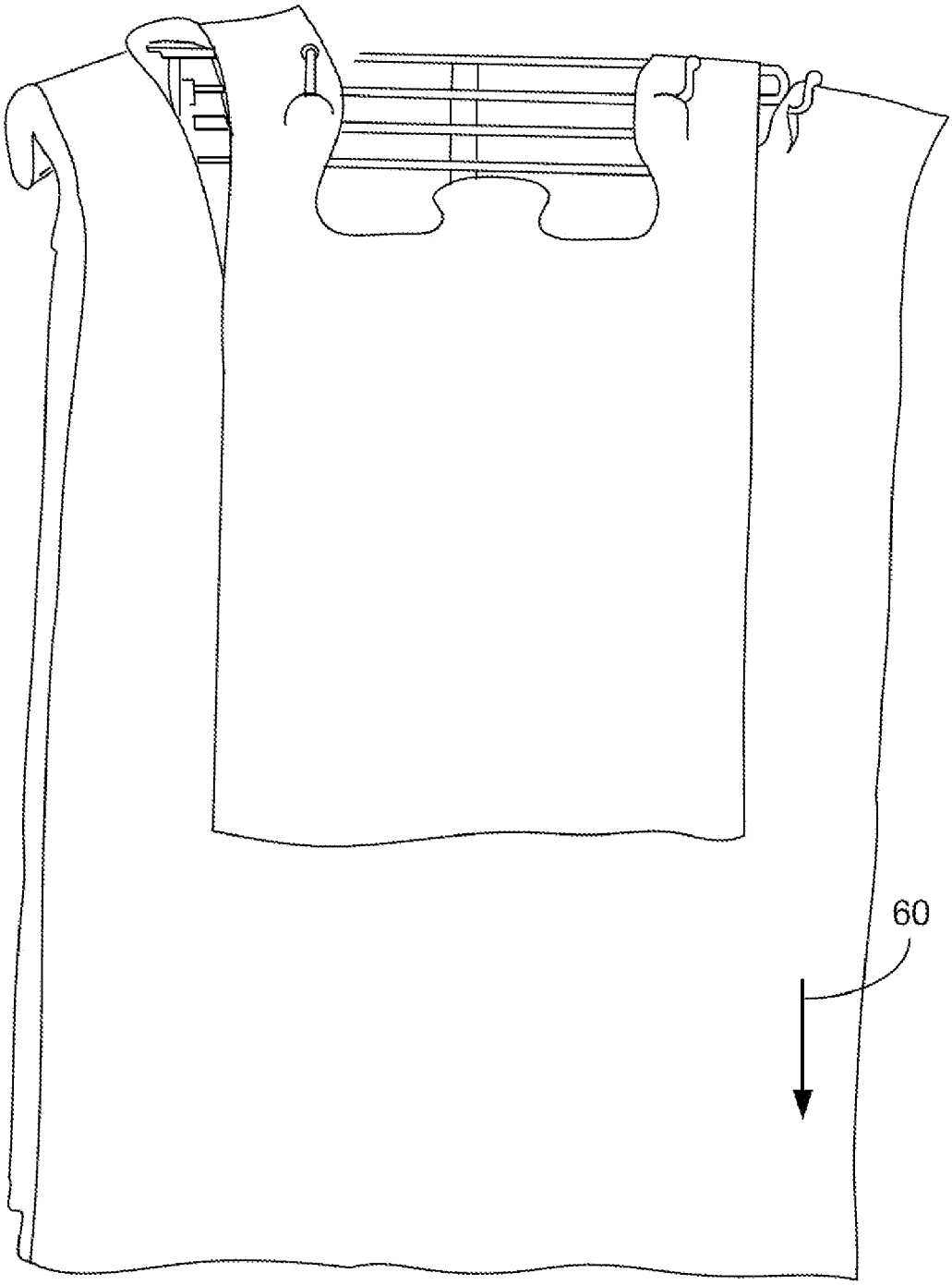
FIG. 3H is a frontal view of the preferred embodiment of the present invention, illustrating first and second stacks of bags mounted on the rack and supported by first and second sets of support hooks, with the second, smaller bag stack overlying the first, larger bags stack.
Figure 3I:
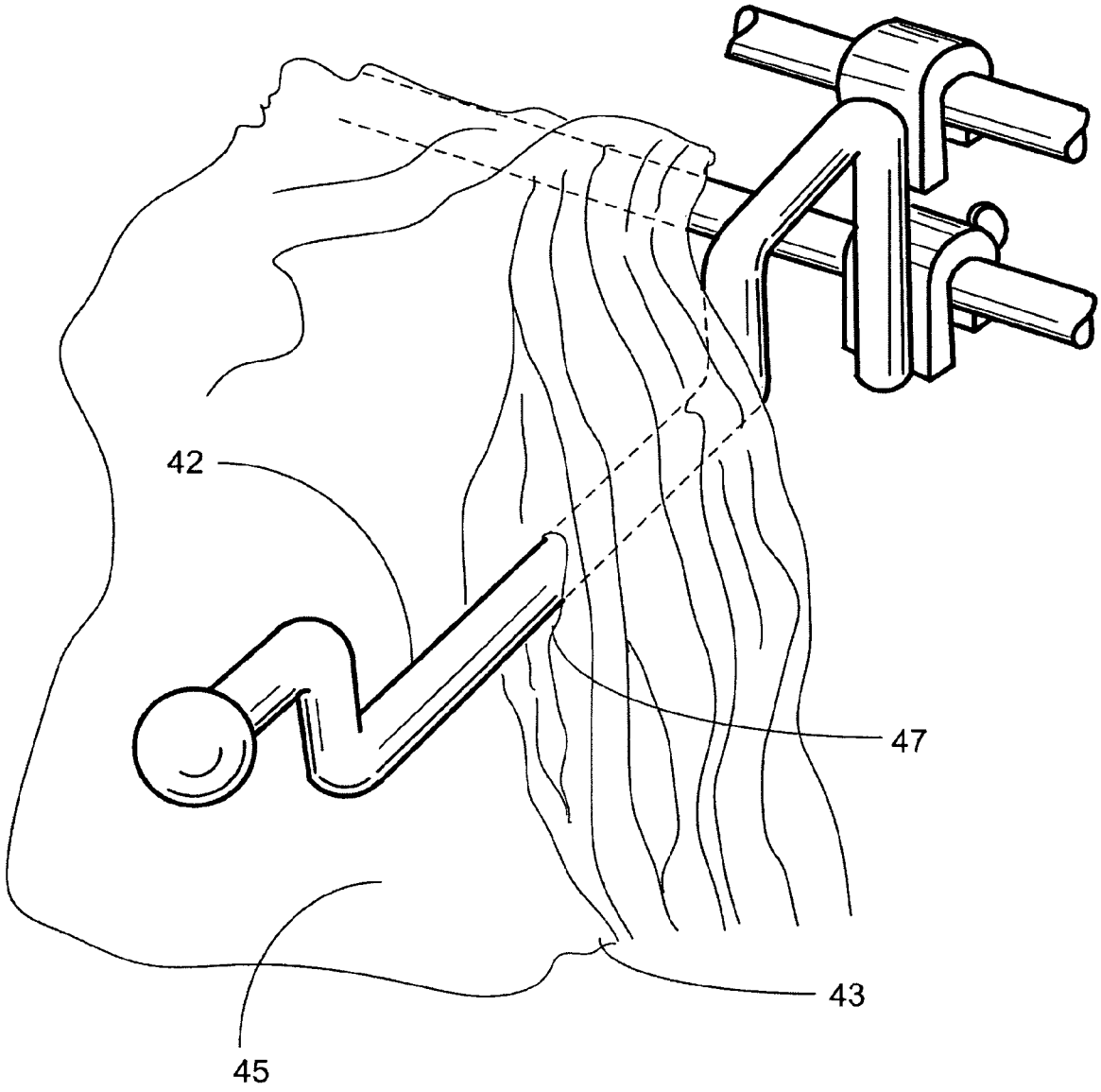
FIG. 3I is a close up view of the support hook passing through the handle support aperture of the larger bag stack, with the handle support aperture formed to allow rupturing of that portion of the bag situated from the inside edge of the handle to the upper portion of the support aperture.
Figure 4A:
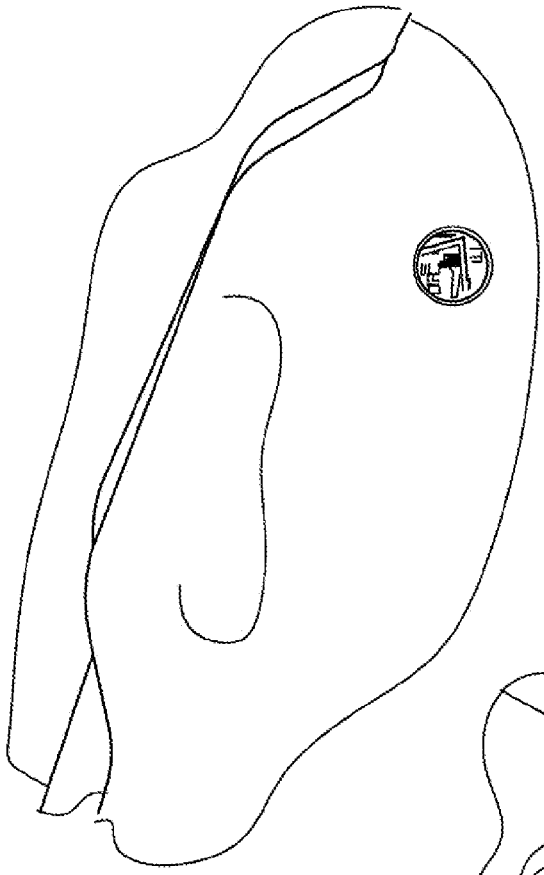
FIG. 4A is a close up view of the support aperture formed in each handle of the bags forming the larger bag stack as shown in FIG. 3F.
Figure 4B:
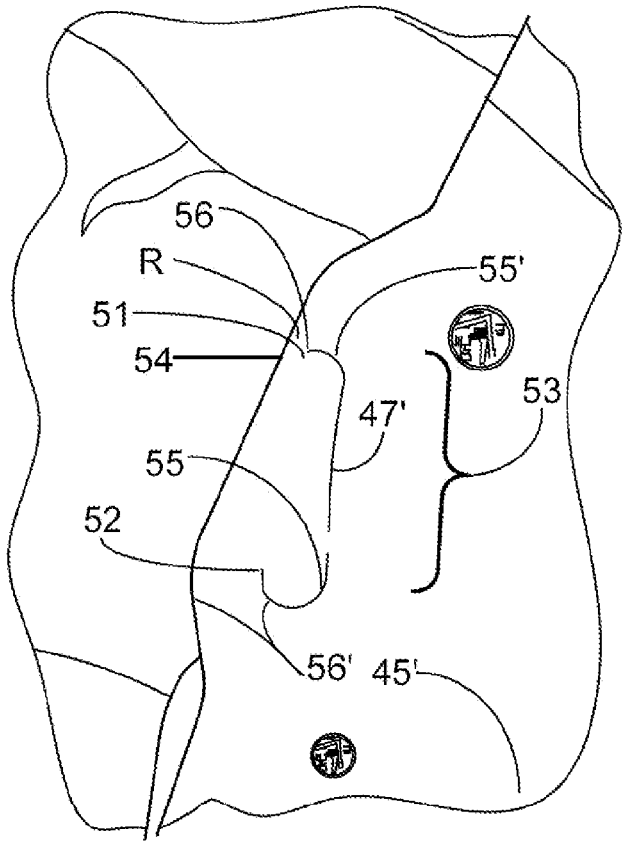
FIG. 4B is a close-up view of the support aperture formed in each handle of the bags forming the larger bag stack as shown in FIG. 3F, illustrating the care this through portion situated between the upper termination of the cut forming the aperture, and the inside edge of the handle.
Figure 4C:
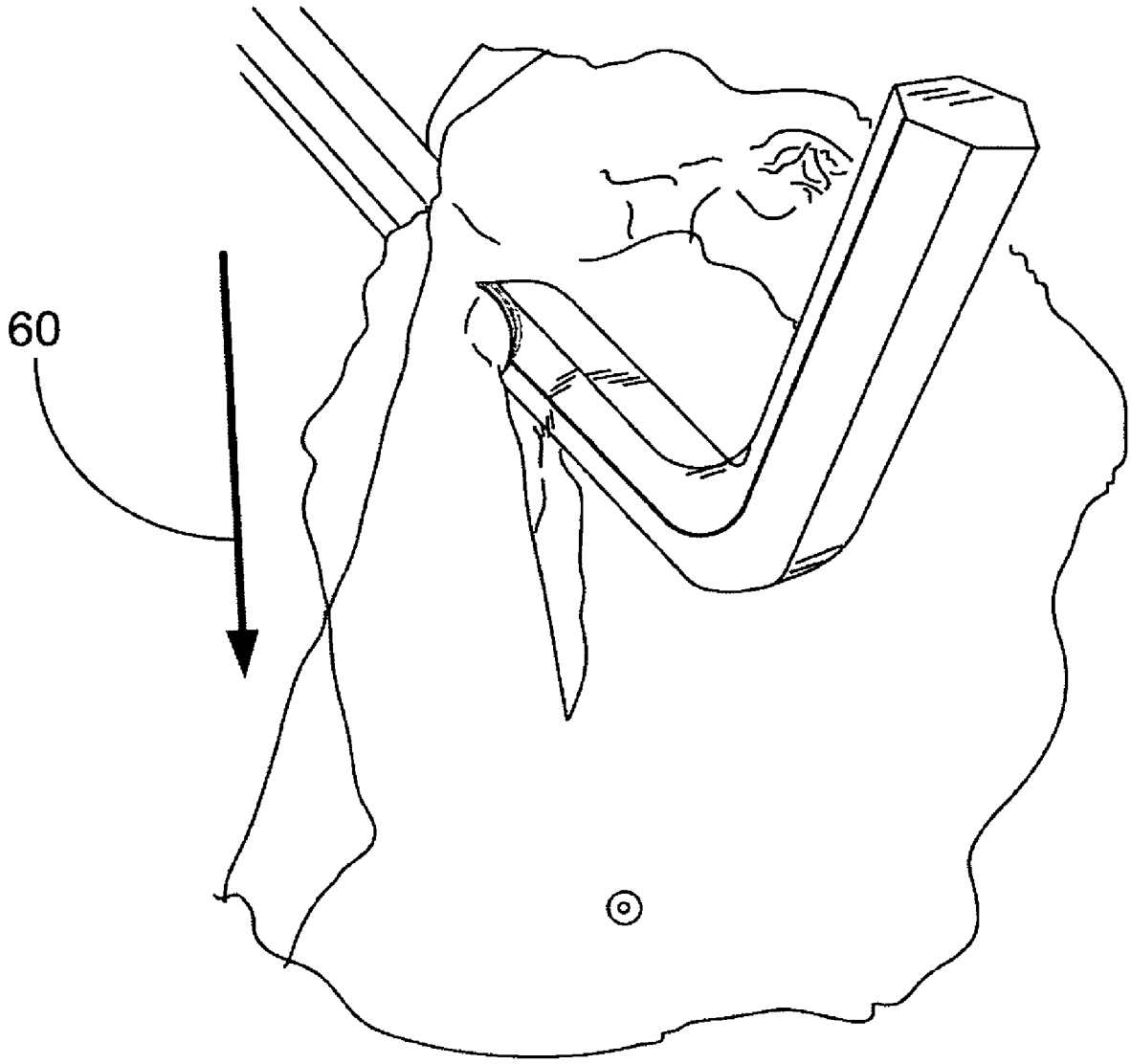
Figure 4D:
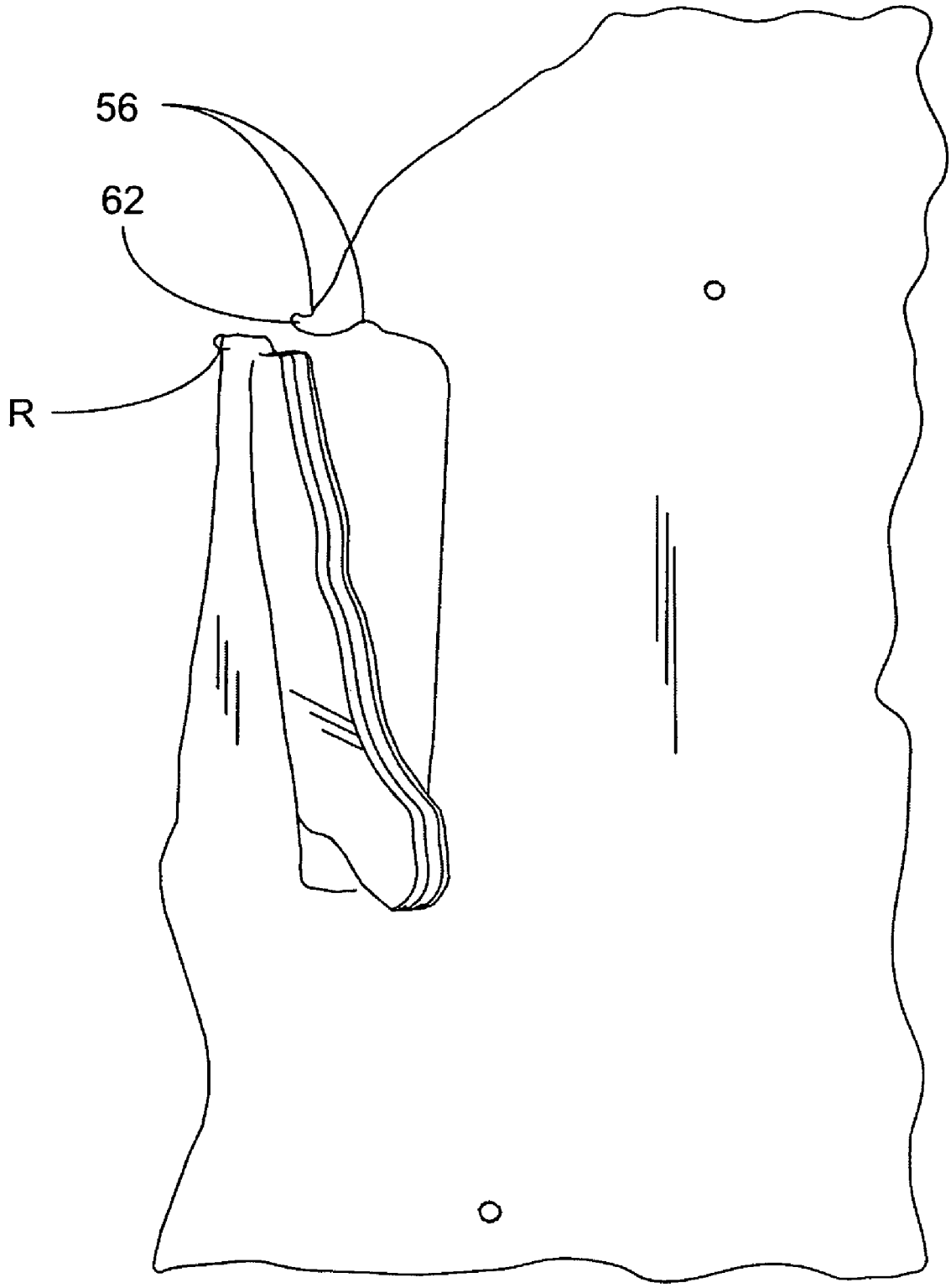
FIG. 4D is a close-up view of the support aperture of FIG. 4C after the bag has been removed from the rack and the bag has been dispensed from the support hook, by removal of the bag from the rack, such that the support hook tears through or ruptures the slim thermoplastic area between the upper terminating end of the cut forming the support aperture and the inside edge of the handle close to said termination point.

In dispensing a bag from the larger 43 or smaller 44 bag pack, the user grasps the outermost bag of the stack from the stack of bags desired, and pulls 60 (FIGS. 3H and 4C) the bag downward 60 (for the larger, underlying bag stack), which applies pressure to the support aperture in the bag being dispensed at the support hook, causing the support apertures to rupture 62 at their respective rupture areas R, the area 56 between the inner edge of the handle and the first end of the support aperture tearing or rupturing due to the applied user pressure upon the bag engaging the respective support handle during the dispensing of the bag.

While the above example illustrated the user applying downward pressure to the larger, underlying bag in the bag stack, it is noted that the overlying, smaller bag stack bags can be dispensed by applying either downward pressure to the outermost bag to be dispensed, or by pulling the smaller bag away from the rack and generally horizontal fashion, as be and will apertures will engage the upward look at the end of the support hooks were stop portion as illustrated in the drawings and discussed above, causing rupturing of the film area at the rupture zone and allowing dispensing of the bags.

It is noted that, while the present example showed a single smaller stack overlying a larger stack of bag, the present system will likewise allow still a third, smaller bag stack to be placed overlying the second smaller bag stack, with the user positioning the support hooks accordingly. An important aspect of the present invention is that the larger bag stacks or mounted closest the rack, with the progressively smaller bag stacks mounted in overlying fashion thereupon, to allow the user unhindered access to whatever size bag they desire.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

I claim:

1. The method of dispensing first and second bag stacks, each of said first and second stacks of bags having first and second support apertures formed therethrough, respectively, comprising the steps of:

a) providing a generally horizontally situated support bar having a length;

a1) providing a first bag stack;

a2) providing a second bag stack;

b) affixing a first bag stack support to said support bar, said first bag stack support comprising first and second support members adjustably situated along the length of said support bar so as to engage said first and second support apertures of said first bag stack, respectively;

c) affixing a second bag stack support to said support bar, said second bag support comprising first and second support members adjustably situated along the length of and formed to engage said first and second support apertures of said second stack of bags, respectively, with said first and second support members of said second bag stack support situated generally between said first and second support members of said first bag stack support;

d) mounting said first bag stack to said rack by passing said first and second support apertures of said first stack of bags about said first and second support members of said first bag stack support;

e) mounting said second bag stack to said rack by passing said first and second support apertures of said second bag stack about said first and second support members of said second bag stack support, with said second bag stack situated in overlying fashion with regard to said first bag stack;

f) grasping an exposed first bag on said second bag stack and pulling same to dispense.

2. The method of claim 1 wherein said first bag stack is larger than said second bag stack, and wherein there is included the additional step f1 after step f of reaching around said second bag stack to grasp the outermost bag on the first bag stack.

* * * * *